US012570457B2

(12) United States Patent
Wei

(10) Patent No.: US 12,570,457 B2
(45) Date of Patent: Mar. 10, 2026

(54) AIR EXTRACTION STRUCTURE AND KEEP-FRESH CONTAINER HAVING SAME

(71) Applicant: Honghua Wei, Zhuhai (CN)

(72) Inventor: Honghua Wei, Zhuhai (CN)

( * ) Notice: Subject to any disclaimer, the term of this patent is extended or adjusted under 35 U.S.C. 154(b) by 98 days.

(21) Appl. No.: 18/559,870

(22) PCT Filed: Dec. 31, 2021

(86) PCT No.: PCT/CN2021/143898

§ 371 (c)(1),
(2) Date: Nov. 9, 2023

(87) PCT Pub. No.: WO2022/237203

PCT Pub. Date: Nov. 17, 2022

(65) Prior Publication Data

US 2024/0199303 A1 Jun. 20, 2024

(30) Foreign Application Priority Data

May 10, 2021 (CN) ..... 202120988089.2

(51) Int. Cl.
*B65D 81/20* (2006.01)
*B65D 21/02* (2006.01)
*B65D 51/16* (2006.01)

(52) U.S. Cl.
CPC ..... *B65D 81/2015* (2013.01); *B65D 21/0209* (2013.01); *B65D 51/16* (2013.01)

(58) Field of Classification Search
CPC ..... B65D 51/16; B65D 51/1644; B65D 81/2015; B65D 21/0209; B65D 2205/02; B65D 83/44; B65D 88/706; A47J 47/10
See application file for complete search history.

(56) References Cited

U.S. PATENT DOCUMENTS 5,169,015 A * 12/1992 Burke ..... F01P 11/0247 220/203.07
6,557,462 B1 * 5/2003 Wang ..... B65D 79/02 219/735

(Continued)

FOREIGN PATENT DOCUMENTS

CN 105398666 A 3/2016
CN 109279173 A 1/2019

(Continued)

*Primary Examiner* — Kareen K Thomas
(74) *Attorney, Agent, or Firm* — Epstein Drangel LLP; Robert L. Epstein

(57) ABSTRACT

An air extraction structure is disclosed, including: an elastic press cover; a seat, which forms an air extraction chamber with the elastic press cover and which is provided with a mounting hole, a plurality of air extraction holes being arranged in the circumferential direction of the mounting hole; a valve seat provided with a receiving hole communicating with the mounting hole and the air extraction hole; a blocking member including a flexible diaphragm and a clamping part, the clamping part is clamped and placed on a lower surface of the seat, a lower surface of the flexible diaphragm can be attached to an upper surface of the valve seat and sealing the air extraction hole, a first reinforcing rib extends circumferentially on the lower surface of the flexible diaphragm; and an air exhaust check valve mounted on the seat. A keep-fresh container is further disclosed.

19 Claims, 13 Drawing Sheets

(56) References Cited

U.S. PATENT DOCUMENTS

| | | | | |
|---|---|---|---|---|
| 6,644,489 | B2 * | 11/2003 | Chang | B65D 81/2038 215/311 |
| 7,131,550 | B2 * | 11/2006 | Vilalta | B65D 79/0087 220/203.11 |
| 7,726,505 | B2 * | 6/2010 | Cheung | F16K 17/42 206/544 |
| 11,999,551 | B1 * | 6/2024 | Luo | B65D 53/02 |
| 12,202,660 | B1 * | 1/2025 | Wang | B65D 51/1683 |
| 2003/0197011 | A1 * | 10/2003 | Nieh | B65D 81/2015 220/203.23 |
| 2004/0084450 | A1 * | 5/2004 | Havens | B65D 51/1644 220/203.07 |
| 2011/0210033 | A1 * | 9/2011 | Chhay | B65D 21/0222 206/505 |
| 2021/0070524 | A1 | 3/2021 | Wei | |

FOREIGN PATENT DOCUMENTS

| | | | |
|---|---|---|---|
| CN | 111907933 | A | 11/2020 |
| CN | 212638547 | U | 3/2021 |

* cited by examiner

AIR EXTRACTION STRUCTURE AND KEEP-FRESH CONTAINER HAVING SAME

CROSS-REFERENCE TO RELATED APPLICATIONS

This application is a national stage filing under 35 U.S.C. § 371 of international application number PCT/CN2021/143898, filed Dec. 31, 2021, which claims priority to Chinese patent application No. 202120988089.2 filed May 10, 2021. The contents of these applications are incorporated herein by reference in their entirety.

TECHNICAL FIELD

The present disclosure relates to the field of keeping-fresh, and in particular, to an air extraction structure and a keep-fresh container.

BACKGROUND

Keep-fresh containers can be used to store food, medicines and the like, which can prolong the storage time of the food and the medicines to a certain extent and prevent contamination. Existing keep-fresh containers are only sealed by the mutual fastening of a container cover and a container body. However, there will be air inside the container body. Over time, this air will breed bacteria, which is not conducive to the storage of food and medicine.

SUMMARY

The present disclosure aims to at least solve one of the technical problems in the conventional technology. Therefore, the present disclosure provides an air extraction structure that can conveniently and quickly extract air from a to-be-extracted container.

The present disclosure further provides a keep-fresh container that can enable the interior of the keep-fresh container to be in a vacuum state and increase the sealing performance of the keep-fresh container.

An air extraction structure according to an embodiment of a first aspect of the present disclosure includes: an elastic press cover; a seat fastened to and in sealing connection with the elastic press cover, where an air extraction chamber is formed between the elastic press cover and the seat, the seat is provided with a mounting hole, and a plurality of air extraction holes are arranged in a circumferential direction of the mounting hole; a valve seat mounted on the seat and provided with a receiving hole, where the receiving hole is communicated with the mounting hole and the air extraction hole; a blocking member including a flexible diaphragm and a clamping part vertically arranged on a lower surface of the flexible diaphragm, where the clamping part passes through the receiving hole and the mounting hole and is clamped and placed on a lower surface of the seat, the lower surface of the flexible diaphragm can be attached to an upper surface of the valve seat and blocks the air extraction hole, the blocking member can move along an axial direction of the mounting hole to control the communication or disconnection between the air extraction chamber and the air extraction hole, the lower surface of the flexible diaphragm has a first reinforcing rib extending circumferentially, and the first reinforcing rib can be attached to the upper surface of the valve seat; and an air exhaust check valve mounted on the seat and configured to exhaust the air from the air extraction chamber.

The air extraction structure has at least the following beneficial effects: when air is extracted, the elastic press cover is pressed, and the elastic press cover can compress the air extraction chamber, so that air in the air extraction chamber is exhausted outwards through the air exhaust check valve. Then, the elastic press cover is released, the elastic press cover can restore to an initial state under the action of the elastic restoring force of the elastic press cover. In this case, the air extraction chamber is in a negative pressure state and can enable the flexible diaphragm to move upwards, and the lower surface of the flexible diaphragm is separated from the valve seat, so that the air extraction chamber can be communicated with the to-be-extracted container through the air extraction hole, and air in the to-be-extracted container can flow into the air extraction chamber through the air extraction hole until the air pressure in the air extraction chamber is equal to the air pressure in the to-be-extracted container. Therefore, by repeatedly performing the above operations, that is, pressing the elastic press cover, the air inside the to-be-extracted container can be extracted. The air extraction structure can conveniently and quickly exhaust the air from the to-be-extracted container by simple pressing action. In addition, according to the present disclosure, the first reinforcing rib is arranged on the flexible diaphragm, so that a strength of the flexible diaphragm at the first reinforcing rib can be enhanced, and the flexible diaphragm is prevented from being deformed; and meanwhile, when the first reinforcing rib is attached to the upper surface of the valve seat, double sealing between the blocking member and the valve seat can be reliably achieved.

According to some embodiments of the present disclosure, an edge of the flexible diaphragm is provided with a second reinforcing rib, and the second reinforcing rib extends around a circumferential direction of the flexible diaphragm.

According to some embodiments of the present disclosure, an inner surface of the elastic press cover is provided with a sealing rib along a circumferential direction of the elastic press cover, the upper surface of the seat is provided with a sealing groove at a position corresponding to the sealing rib, and the sealing rib can be inserted into the sealing groove when the elastic press cover is fastened on the seat.

According to some embodiments of the present disclosure, the valve seat is provided with a protrusion, and the protrusion extends along a circumferential direction of the valve seat and can abut against the lower surface of the flexible diaphragm.

According to some embodiments of the present disclosure, the valve seat and the flexible diaphragm are both made of silicone material.

According to some embodiments of the present disclosure, the elastic press cover is made of PP material.

A keep-fresh container according to an embodiment of a second aspect of the present disclosure includes the air extraction structure according to the embodiment of the first aspect of the present disclosure, and further includes a container cover and a container body, the container cover and container body can be in sealing connection, the air extraction structure is sealed on the container cover, the container cover is provided with a communication hole, and the air extraction hole is communicated with the interior of the container body through the communication hole.

The keep-fresh container has at least the following beneficial effects: when the keep-fresh container is used, the elastic press cover of the air extraction structure can be repeatedly pressed, so that air in the container body enters the air extraction chamber through the air extraction hole and is exhausted from the keep-fresh container through the air exhaust check valve, the interior of the keep-fresh container can be in a vacuum state through the air extraction structure, and the storage time of substances inside the keep-fresh container is prolonged; and the air extraction structure can be directly mounted on the keep-fresh container, which is convenient for carry and use. In addition, since the interior of the vacuumized container body is in a negative pressure state, the container cover and the container body can be fastened more tightly, and the sealing performance of the keep-fresh container can be enhanced.

According to some embodiments of the present disclosure, the container cover is further provided with a mounting groove, the air extraction structure can be accommodated in the mounting groove, an air exhaust chamber is formed between the seat and the mounting groove, an air exhaust groove is formed on a side surface outside the elastic press cover, the air exhaust groove is communicated with the air exhaust chamber, and air in the air extraction chamber can be exhausted outside the container cover through the air exhaust check valve, the air exhaust chamber and the air exhaust groove in sequence.

According to some embodiments of the present disclosure, a middle part of the elastic press cover is arc-shaped and protrudes from an upper surface of the container cover, a lower surface of the container body is provided with an arc-shaped groove, a plurality of keep-fresh containers can be longitudinally stacked, and an arc-shaped groove on previous container body is matched with an elastic press cover of next container cover.

According to some embodiments of the present disclosure, a bottom surface of the container body is uniformly distributed with a plurality of support legs, an upper surface of the container cover is uniformly distributed with a plurality of positioning grooves, and a plurality of support legs on previous container body can be correspondingly accommodated in a plurality of positioning grooves of next container cover.

Additional aspects and advantages of the present disclosure will be set forth in part in the following description, some of which will be apparent from the following description, or will be learned by practice of the present disclosure.

BRIEF DESCRIPTION OF DRAWINGS

The above and/or additional aspects and advantages of the present disclosure will become apparent and readily appreciated from the following description of the embodiments with reference to the accompanying drawings. In the drawings.

Figure 1:
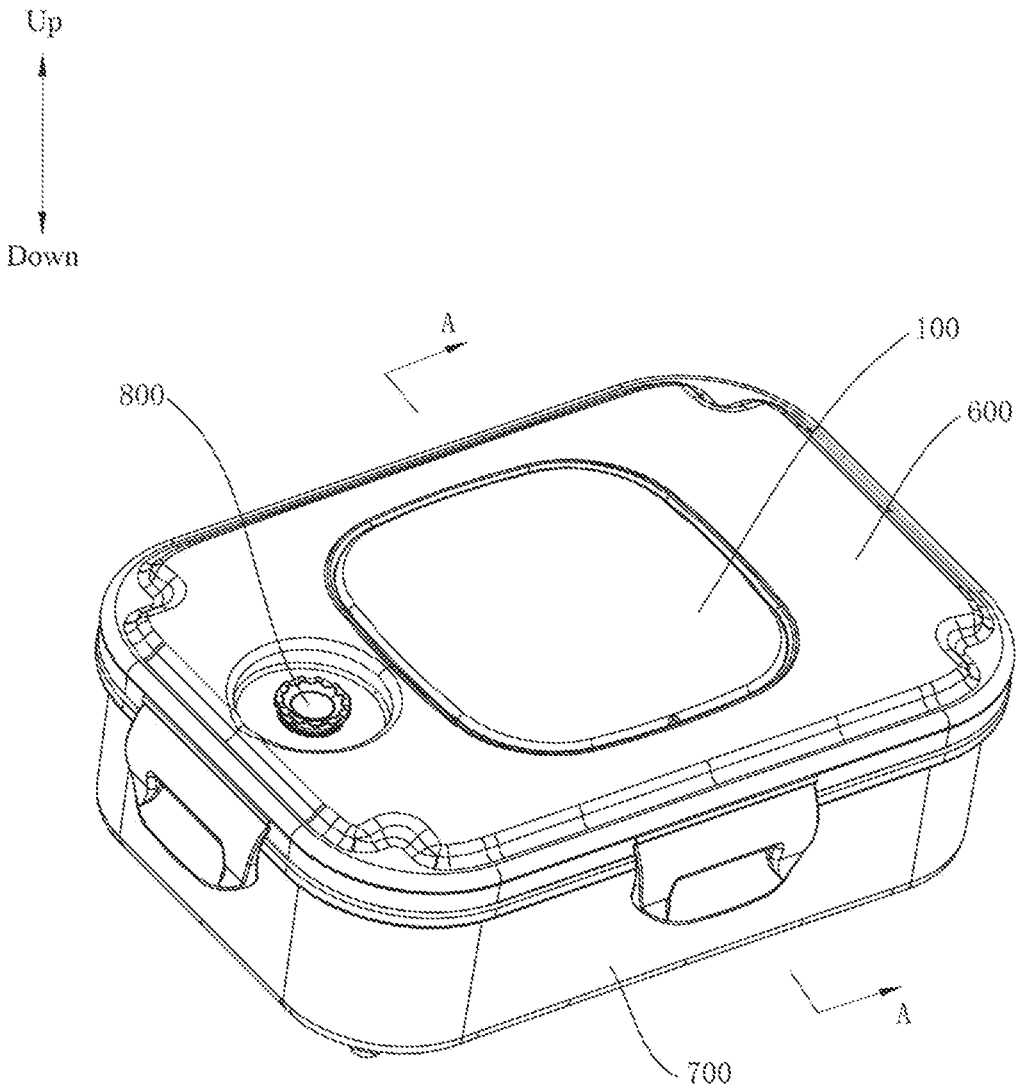
FIG. 1 is a schematic diagram of a structure of an embodiment according to a second aspect of the present disclosure.

Reference numerals are as follows: 100: elastic press cover, 110: air extraction chamber, 120: sealing rib, 130: air exhaust groove, 200: seat, 210: mounting hole, 220: air extraction hole, 230: sealing groove, 300: blocking member, 310: flexible diaphragm, 311: first reinforcing rib, 312: second reinforcing rib, 320: clamping part, 400: air exhaust check valve, 500: valve seat, 510: receiving hole, 511: protrusion, 600: container cover, 610: communication hole, 620: mounting groove, 630: air exhaust chamber, 640: positioning groove, 700: container body, 710: arc-shaped groove, 720: support leg, 800: sealing plug, 900: sealing ring.

DETAILED DESCRIPTION

Embodiments of the present disclosure will be described in detail below, and examples of the embodiments are shown in the accompanying drawings, where the same or similar reference numerals indicate the same or similar elements or elements having the same or similar functions throughout. The embodiments described below with reference to the accompanying drawings are illustrative only for the purpose of explaining the present disclosure, and are not to be construed as limiting the present disclosure.

In the description of the present disclosure, it should be understood that directional descriptions are related, for example, directions or positional relationships indicated by terms such as "up", "down" and the like are those shown based on the accompanying drawings, and are merely intended to facilitate and simplify the description of the present disclosure but not indicate or imply that the indicated apparatus or element must have a specific direction and must be configured and operated according to the specific direction. Therefore, these directions or positional relationships should not be construed as limiting the present disclosure.

In the description of the present disclosure, "a plurality of" means one or more, and "multiple" means two or more. The description of "first" and "second" is merely for the purpose of distinguishing technical features, but shall not be understood as an indication or implication of relative importance, or an implicit indication of a quantity of indicated technical features, or an implicit indication of the sequence of the indicated technical features.

In the description of the present disclosure, unless otherwise explicitly defined, terms such as "arrange", "mount", "accommodate", "communicate", "connect" and the like should be understood in a broad sense, and those skilled in the art can reasonably determine the specific meanings of the above terms in the present disclosure in conjunction with the specific contents of the technical solutions.

Referring to FIGS. 1 to 13, the present disclosure discloses an air extraction structure, which includes an elastic press cover 100, a seat 200, a blocking member 300, and an air exhaust check valve 400.

The seat 200 is fastened to and in sealing connection with the elastic press cover 100, an air extraction chamber 110 is formed between the elastic press cover 100 and the seat 200. The seat 200 is provided with a mounting hole 210, and a plurality of air extraction holes 220 are arranged in a circumferential direction of the mounting hole 210. A valve seat 500 is mounted on the seat 200, the valve seat 500 is provided with a receiving hole 510, and the receiving hole 510 is communicated with the mounting hole 210 and the air extraction hole 220. The blocking member 300 includes a flexible diaphragm 310 and a clamping part 320 vertically arranged on a lower surface of the flexible diaphragm 310, the clamping part 320 passes through the receiving hole 510 and the mounting hole 210 and is clamped and placed on a lower surface of the seat 200. The lower surface of the flexible diaphragm 310 can be attached to an upper surface of the valve seat 500 and blocks the air extraction hole 220, the blocking member 300 can move along an axial direction of the mounting hole 210 to control the communication or disconnection between the air extraction chamber 110 and the air extraction hole 220. The lower surface of the flexible diaphragm 310A has a first reinforcing rib 311 extending circumferentially, the first reinforcing rib 311 can be attached to the upper surface of the valve seat 500, and the air exhaust check valve 400 is mounted on the seat 200 and configured to exhaust the air from the air extraction chamber 110.

It should be understood that, when air is extracted, the elastic press cover 100 is pressed, and the elastic press cover 100 can compress the air extraction chamber 110, so that air in the air extraction chamber 110 is exhausted outwards through the air exhaust check valve 400. Then, the elastic press cover 100 is released, the elastic press cover 100 can restore to an initial state under the action of the elastic restoring force of the elastic press cover. In this case, the air extraction chamber 110 is in a negative pressure state and can enable the flexible diaphragm 310 to move upwards, and the lower surface of the flexible diaphragm 310 is separated from the valve seat 500, so that the air extraction chamber 110 can be communicated with the to-be-extracted container through the air extraction hole 220, and air in the to-be-extracted container can flow into the air extraction chamber 110 through the air extraction hole 220 until the air pressure in the air extraction chamber 110 is equal to the air pressure in the to-be-extracted container. Therefore, by repeatedly performing the above operations, that is, pressing the elastic press cover 100, the air inside the to-be-extracted container can be extracted. The air extraction structure can conveniently and quickly exhaust the air from the to-be-extracted container only by simple pressing action. In addition, according to the present disclosure, the first reinforcing rib 311 is arranged on the flexible diaphragm 310, so that a strength of the flexible diaphragm 310 at the first reinforcing rib 311 can be enhanced, and the flexible diaphragm 310 is prevented from being deformed; and meanwhile, when the first reinforcing rib 311 is attached to the upper surface of the valve seat 500, double sealing between the blocking member 300 and the valve seat 500 can be reliably achieved.

Figure 3:
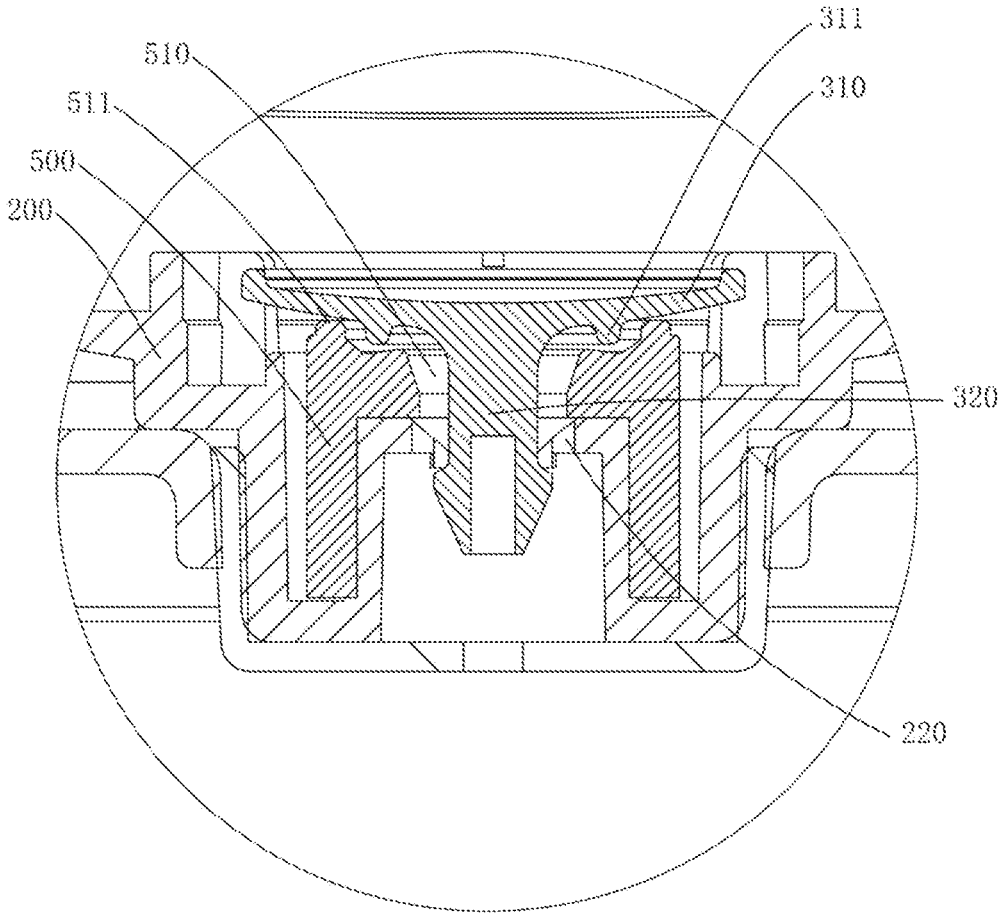
FIG. 3 is a schematic diagram of a partial enlarged structure of the position B in FIG. 2.

Specifically, referring to FIG. 3, the blocking member 300 may be connected to the seat 200 by ultrasonic welding. However, the ultrasonic welding can affect the assembly efficiency and cause high production cost, and the blocking member 300 or the seat 200 is inconvenient to be replaced when damaged, which can cause product waste and increase the rework cost. The blocking member 300 in the present disclosure is provided with the clamping part 320, and the clamping part 320 can pass through the mounting hole 210 and be clamped and placed on the lower surface of the seat 200, so that the assembly between the blocking member 300 and the seat 200 is more efficient and convenient, and the production efficiency can be improved. When the blocking member 300 or the seat 200 is damaged, the blocking member 300 can be detached from the seat 200 for replacement, so that the production cost is saved.

Figure 2:
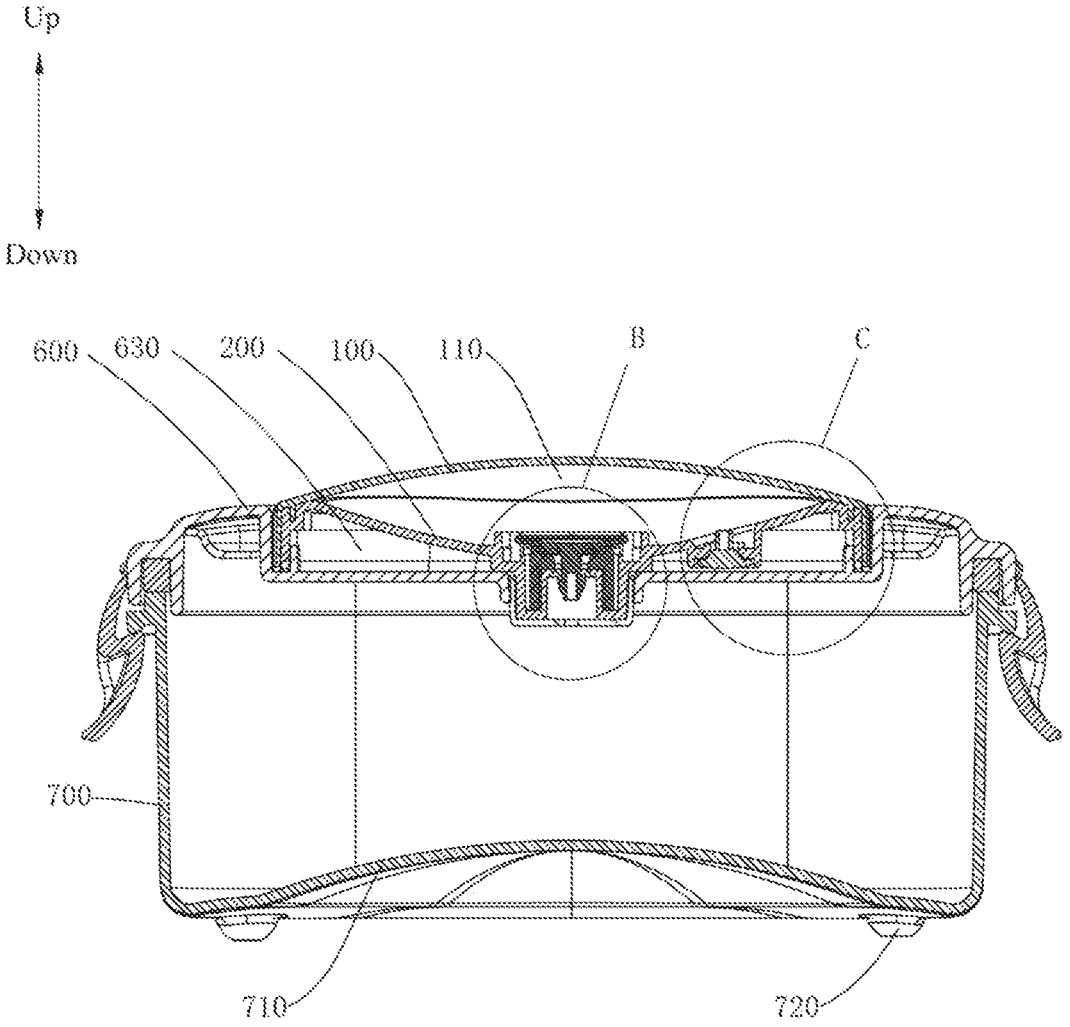
FIG. 2 is a schematic sectional structural diagram along the A-A direction in FIG. 1.

In addition, referring to FIG. 2, a spring may be arranged between the elastic press cover 100 and the seat 200 to assist the elastic press cover 100 to reset. However, since the spring is made of a metal material, it is not suitable to be placed in a microwave oven for heating. Therefore, if the air extraction structure of the present disclosure is applied to a to-be-extracted container that can be placed in a microwave oven, it is not suitable to arrange a spring between the elastic press cover 100 and the seat 200. In some embodiments of the present disclosure, the elastic press cover 100 may be made of PP material, i.e., polypropylene. The PP material is non-toxic and high temperature resistant, has good elasticity, and is easily deformed and restored to its original shape; therefore, the elastic press cover 100 can be smoothly pressed without arranging a spring between the elastic press cover 100 and the seat 200. The elastic press cover 100 made of the PP material has a strong rebound force when the air in the air extraction chamber 110 is reduced to a specific extent, that is, after the elastic press cover 100 is pressed down, the elastic press cover 100 rebounds and accompanies with obvious sound, in this case, the prompt of the completion of the air extraction process is achieved, and a user does not need to continue to extract air from a to-be-extracted container, which is convenient for the user to use.

Figure 8:
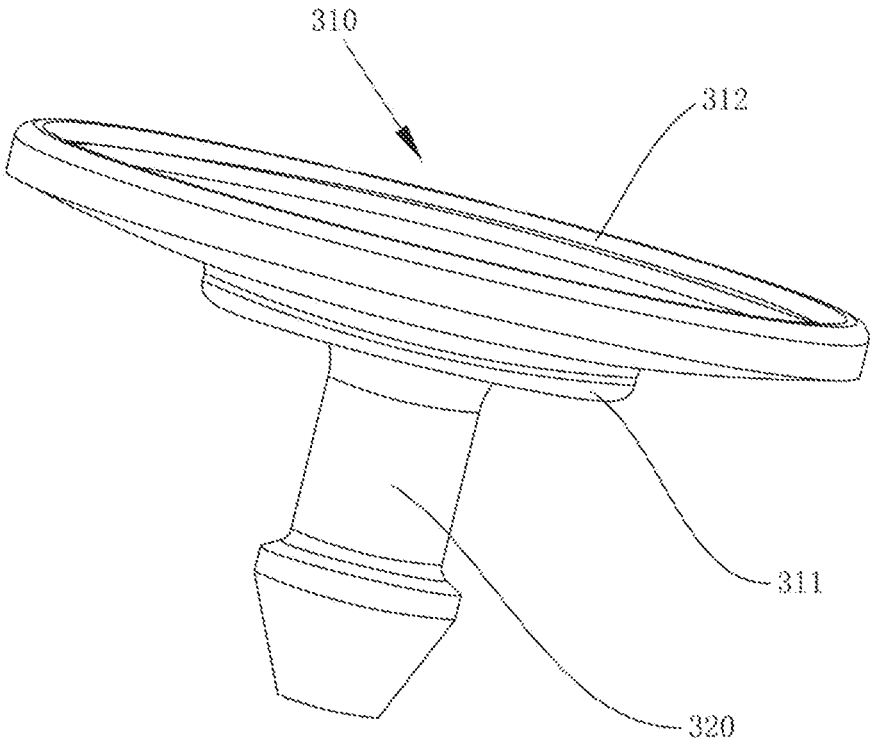
FIG. 8 is a schematic diagram of a structure of a blocking member in an embodiment according to the present disclosure.

Referring to FIG. 8, in some embodiments of the present disclosure, an edge of the flexible diaphragm 310 is provided with a second reinforcing rib 312, and the second reinforcing rib 312 extends around a circumferential direction of the flexible diaphragm 310. The second reinforcing rib 312 can increase the thickness of the edge of the flexible diaphragm 310, thereby preventing the flexible diaphragm 310 from being deformed and affecting the use after production.

Figure 4:
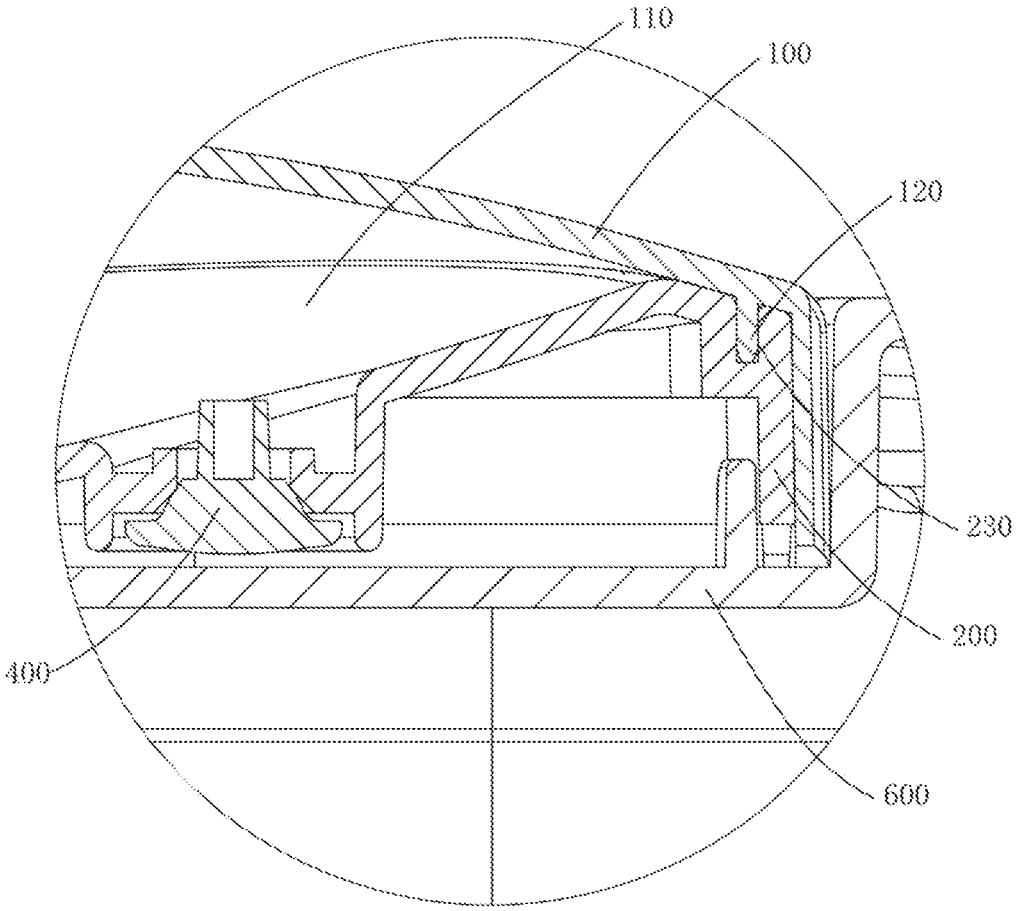
FIG. 4 is a schematic diagram of a partial enlarged structure of the position C in FIG. 2.
Figure 6:
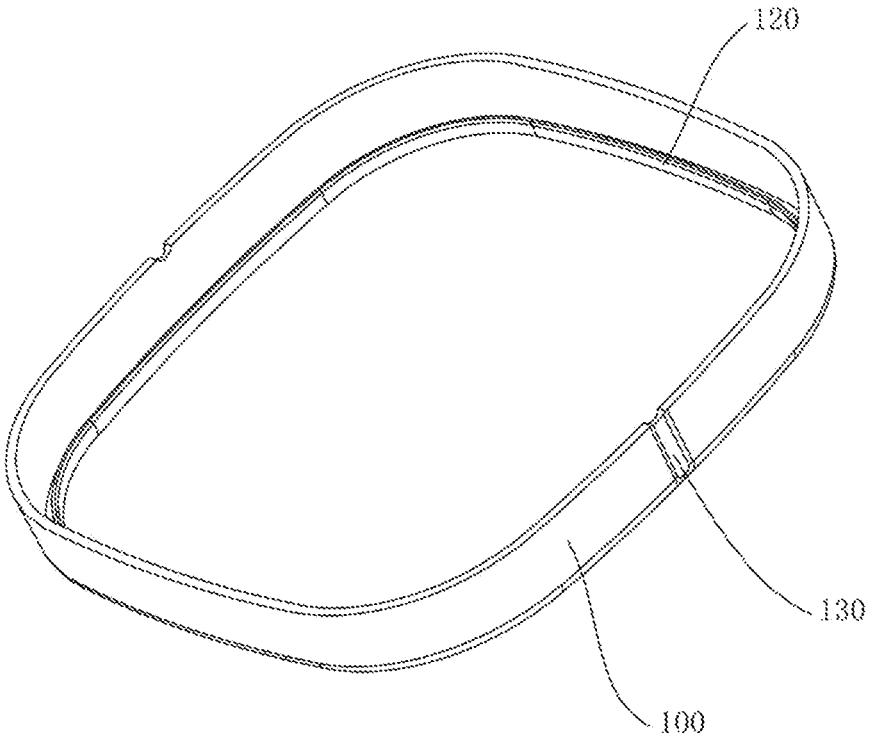
FIG. 6 is a schematic diagram of a structure of an elastic press cover in an embodiment according to the present disclosure.
Figure 7:
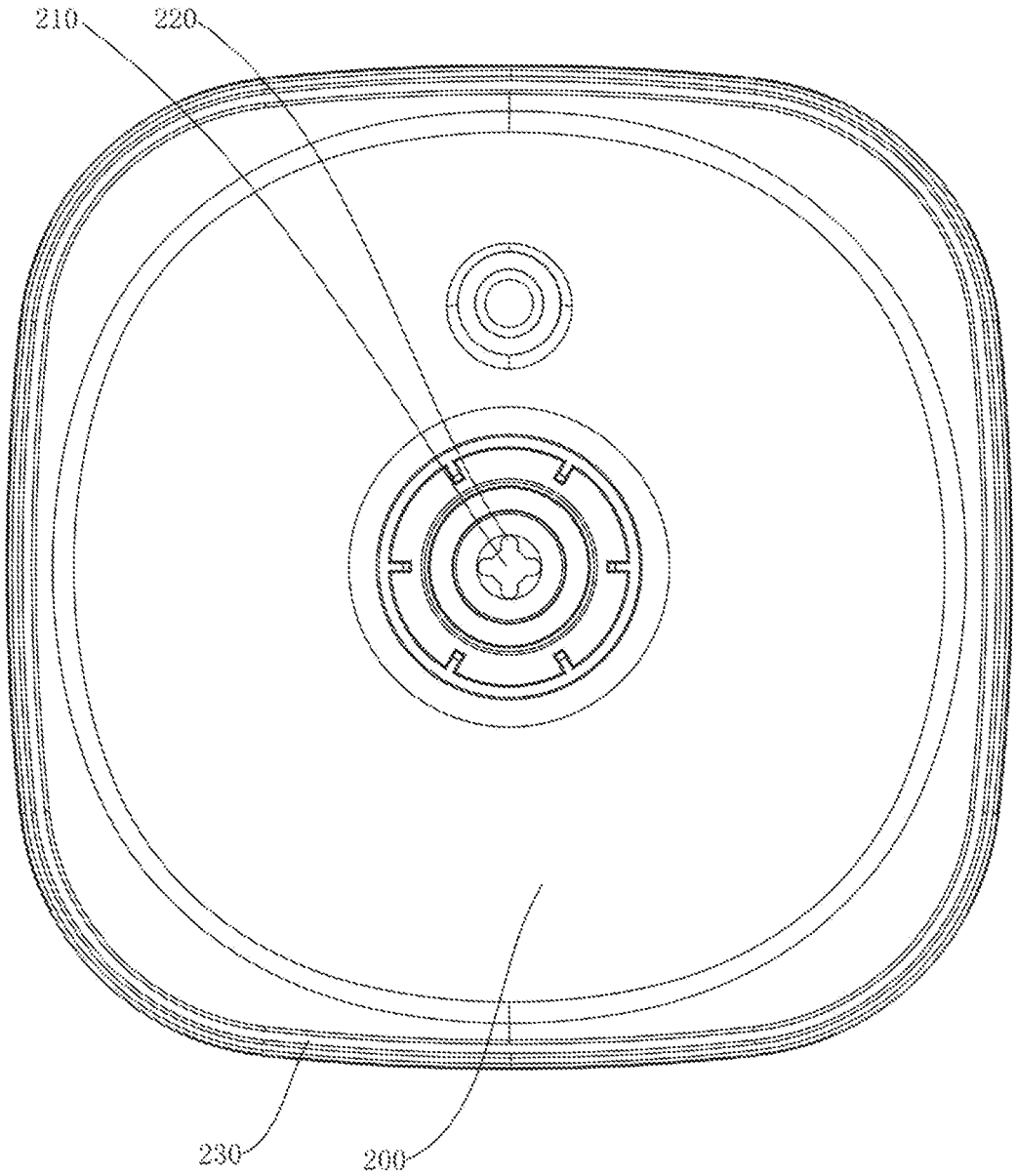
FIG. 7 is a schematic diagram of a structure of a seat in an embodiment according to the present disclosure.

Referring to FIGS. 4, 6 and 7, in some embodiments of the present disclosure, an inner surface of the elastic press cover 100 is provided with a sealing rib 120 along a circumferential direction of the elastic press cover 100, the upper surface of the seat 200 is provided with a sealing groove 230 at a position corresponding to the sealing rib 120, and the sealing rib 120 can be inserted into the sealing groove 230 when the elastic press cover 100 is fastened on the seat 200. The elastic press cover 100 can also be fastened to the seat 200 by applying glue, that is, an inner periphery of the elastic press cover 100 is applied with glue and fastened to the seat 200 to adhere the elastic press cover and the seat to each other. However, this connection manner seriously affects the production efficiency and is not easy for disassembly. According to the present disclosure, the sealing rib 120 is arranged on the elastic press cover 100, and the sealing groove 230 is arranged on the seat 200, and when the elastic press cover 100 is fastened to the seat 200, the sealing rib 120 can be inserted into the sealing groove 230, this sealing manner is convenient and quick and is easy for disassembly, and the sealing performance after the elastic press cover 100 and the seat 200 are fastened can be ensured.

Figure 5:
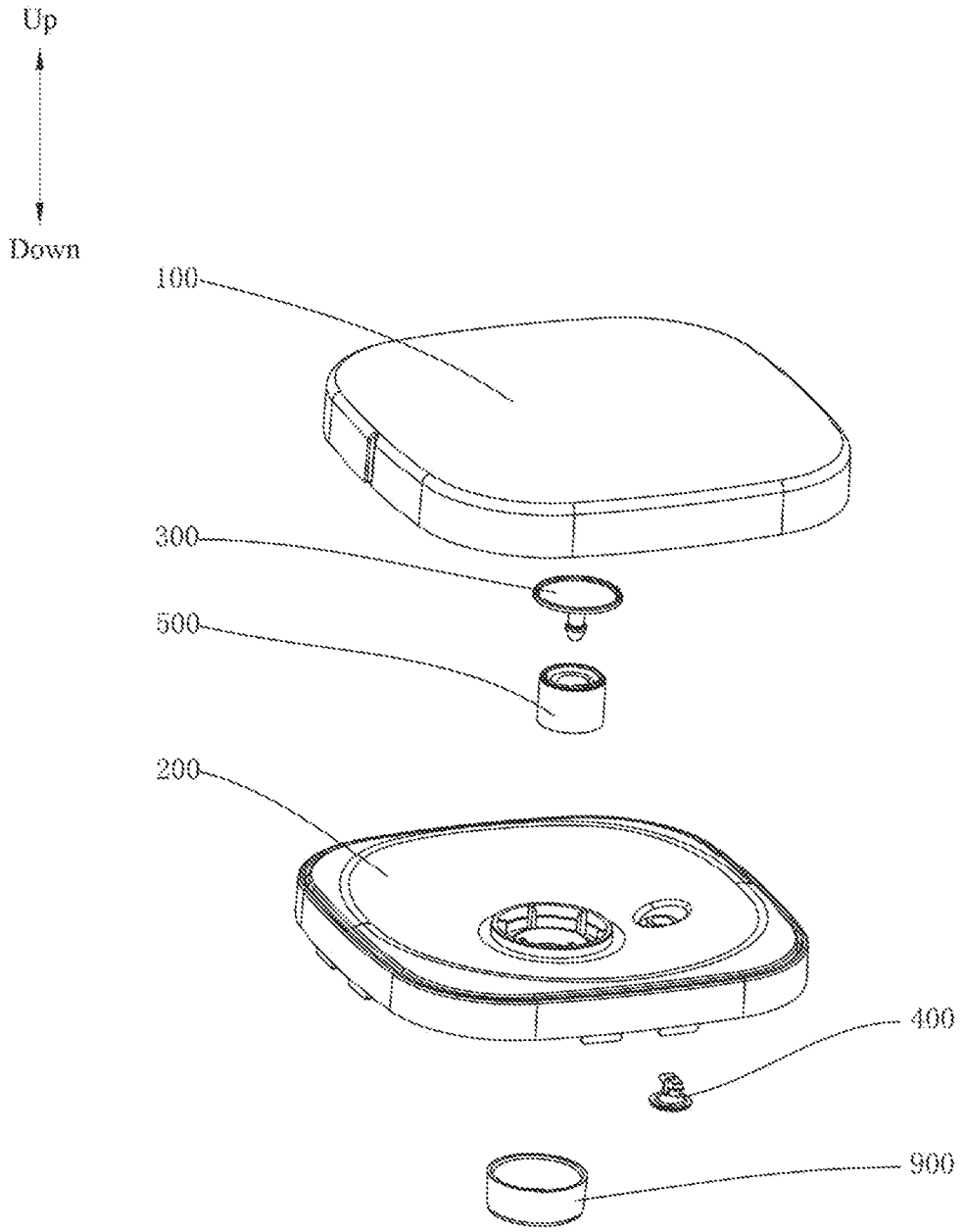
FIG. 5 is a schematic diagram of an exploded structure of an embodiment according to a first aspect of the present disclosure.

Referring to FIGS. 3 and 5, in some embodiments of the present disclosure, the valve seat 500 is provided with a protrusion 511, and the protrusion 511 extends along a circumferential direction of the valve seat 500 and can abut against the lower surface of the flexible diaphragm 310. The protrusion 511 abuts against the lower surface of the flexible diaphragm 310, so that the blocking member 300 can seal the air extraction hole 220 more reliably.

Further, in some embodiments of the present disclosure, the valve seat 500 and the flexible diaphragm 310 are made of silicone material, so that the valve seat 500 and the flexible diaphragm 310 can be flexibly cooperated, and a more reliable sealing effect can be achieved. The silicone has stable performance and is non-toxic and harmless to the human body, so it is suitable for manufacturing the parts relating to food preservation.

Referring to FIG. 1, the present disclosure further discloses a keep-fresh container, which includes the air extraction structure as described above, and further includes a container cover 600 and a container body 700, the container cover 600 and container body 700 can be in sealing connection, the air extraction structure is sealed on the container cover 600, the container cover 600 is provided with a communication hole 610, and the air extraction hole 220 is communicated with the interior of the container body 700 through the communication hole 610.

It should be understood that, when the keep-fresh container is used, the elastic press cover 100 of the air extraction structure can be repeatedly pressed, so that air in the container body 700 enters the air extraction chamber 110 through the air extraction hole 220 and is exhausted from the keep-fresh container through the air exhaust check valve 400, the interior of the keep-fresh container can be in a vacuum state through the air extraction structure, and the storage time of substances inside the keep-fresh container is prolonged. The air extraction structure can be directly mounted on the keep-fresh container, which is convenient for carry and use. In addition, since the interior of the vacuumized container body 700 is in a negative pressure state, the container cover 600 and the container body 700 can be fastened more tightly, and the sealing performance of the keep-fresh container can be enhanced.

Figure 9:
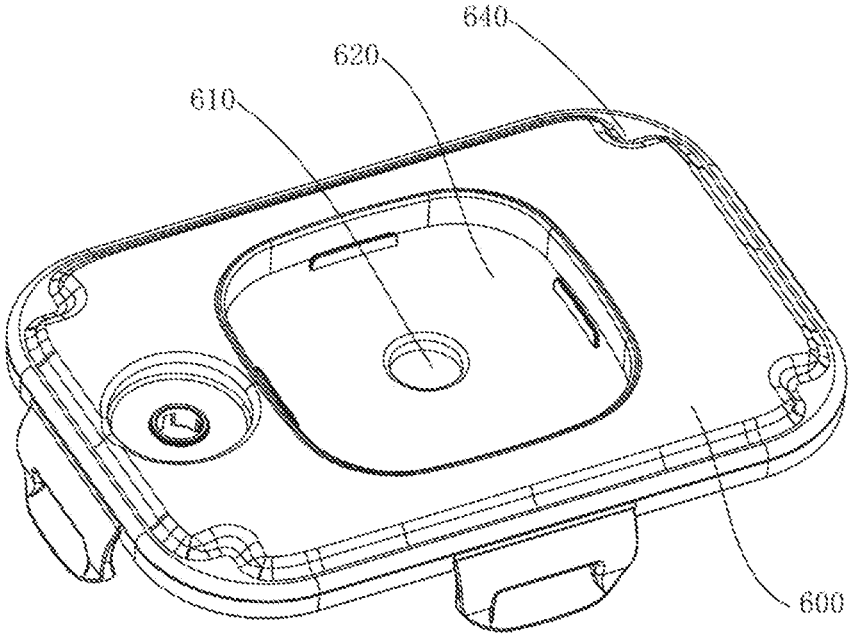
FIG. 9 is a schematic diagram of a structure of a container cover in an embodiment according to the present disclosure.

Referring to FIG. 9, in some embodiments of the present disclosure, the container cover 600 is further provided with a mounting groove 620, the air extraction structure can be accommodated in the mounting groove 620, an air exhaust chamber 630 is formed between the seat 200 and the mounting groove 620. An air exhaust groove 130 is formed on a side surface outside the elastic press cover 100, the air exhaust groove 130 is communicated with the air exhaust chamber 630, and air in the air extraction chamber 110 can be exhausted outside the container cover 600 through the air exhaust check valve 400, the air exhaust chamber 630 and the air exhaust groove 130 in sequence. Further, the seat 200 can be inserted into the communication hole 610 of the container cover 600 at a position corresponding to the air extraction hole 220, and a sealing ring 900 may be arranged between the seat 200 and the communication hole 610 for sealing.

Further, the container cover 600 may also be provided with a sealing plug 800. When a user needs to open the keep-fresh container of which the interior is in a vacuum state, since the container cover 600 and the container body 700 are fastened too tightly and are not easily separated, in this case, the sealing plug 800 on the container cover 600 may be pulled down, so that the interior of the container body 700 is communicated with the external air pressure.

Referring to FIGS. 10 to 13, in some embodiments of the present disclosure, a middle part of the elastic press cover 100 is arc-shaped and protrudes from an upper surface of the container cover 600, a lower surface of the container body 700 is provided with an arc-shaped groove 710, a plurality of keep-fresh containers can be longitudinally stacked, and an arc-shaped groove 710 on previous container body 700 is matched with an elastic press cover 100 of next container cover 600. The shape of the keep-fresh container can be round, rectangular, square, or the like. Further, the size of the stacked keep-fresh containers can be gradually increased from top to bottom. When these keep-fresh containers are not used, a keep-fresh container with a small size can be placed in a keep-fresh container with a large size, so that the keep-fresh containers are convenient for storage.

Figure 10:
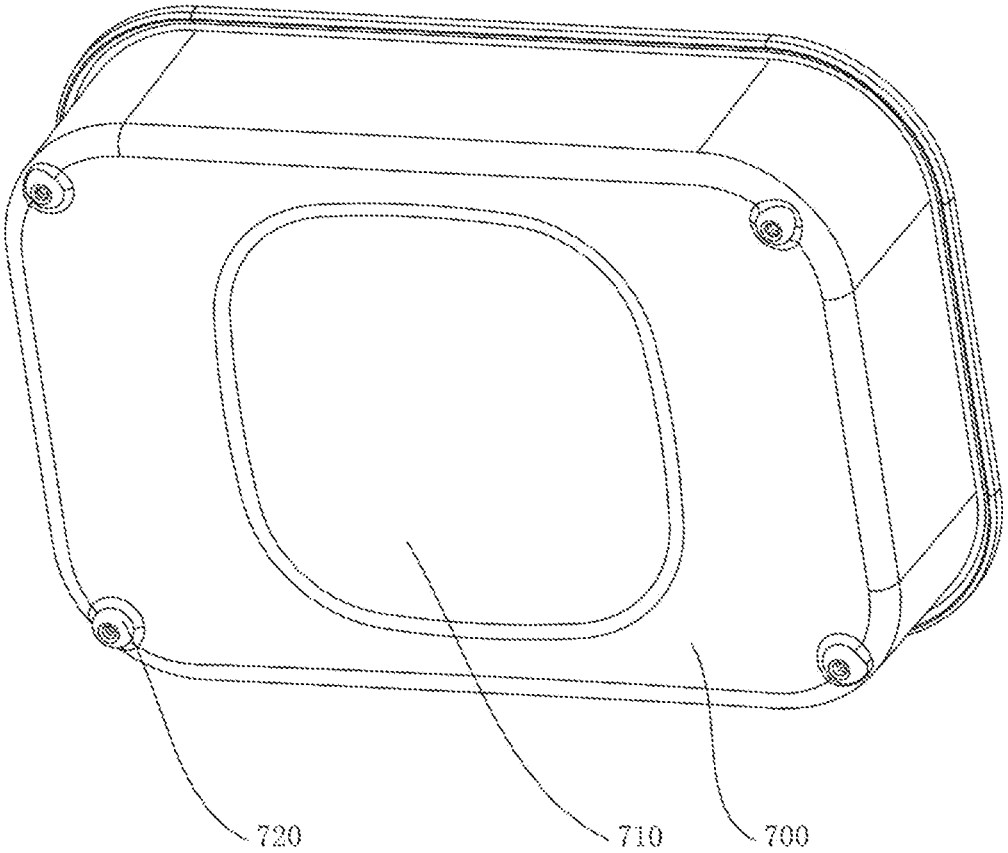
FIG. 10 is a schematic diagram of a structure of a container body in an embodiment according to the present disclosure.
Figure 11:
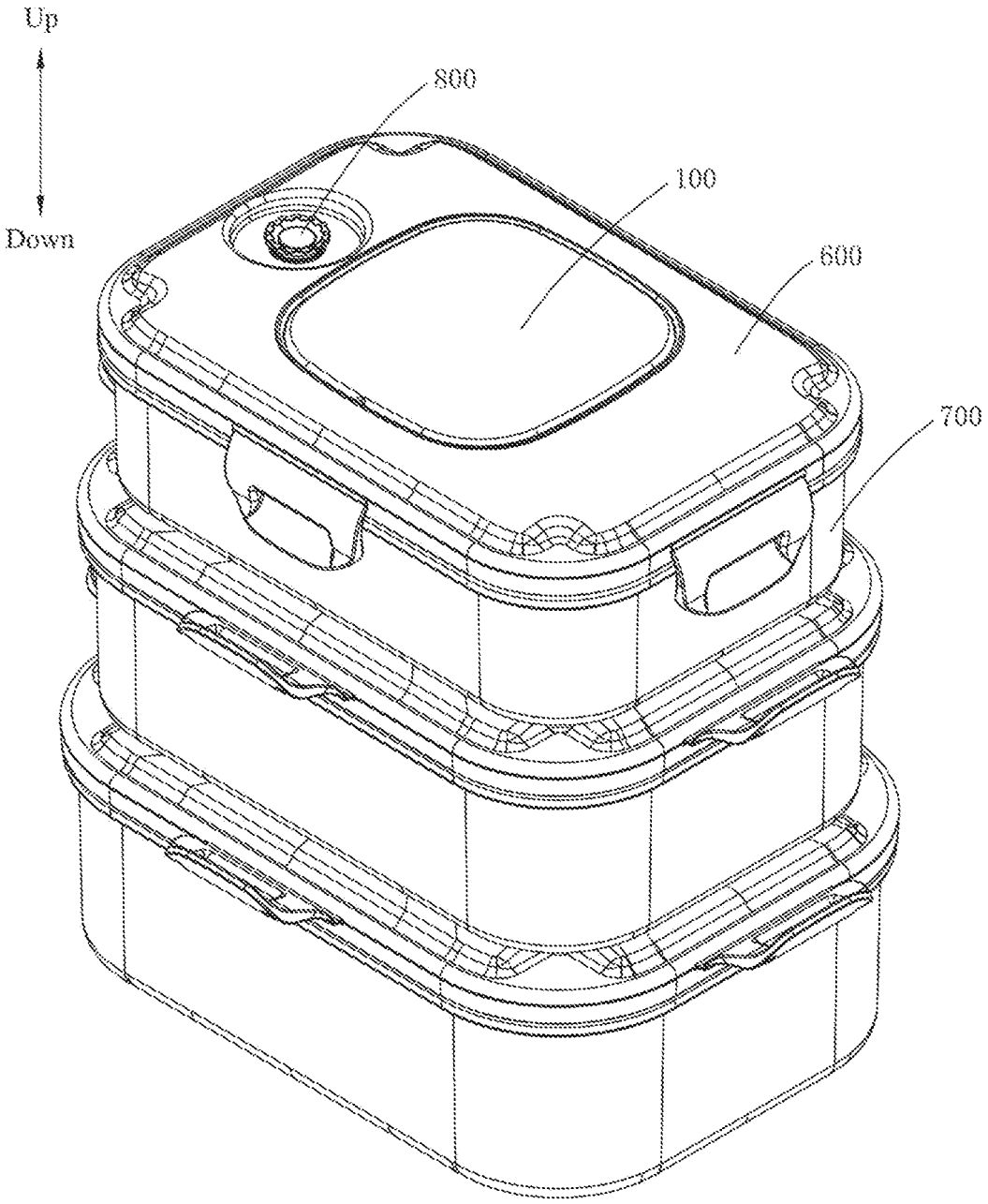
FIG. 11 is a schematic diagram of a structure of stacked rectangular keep-fresh containers in an embodiment according to the present disclosure.
Figure 12:
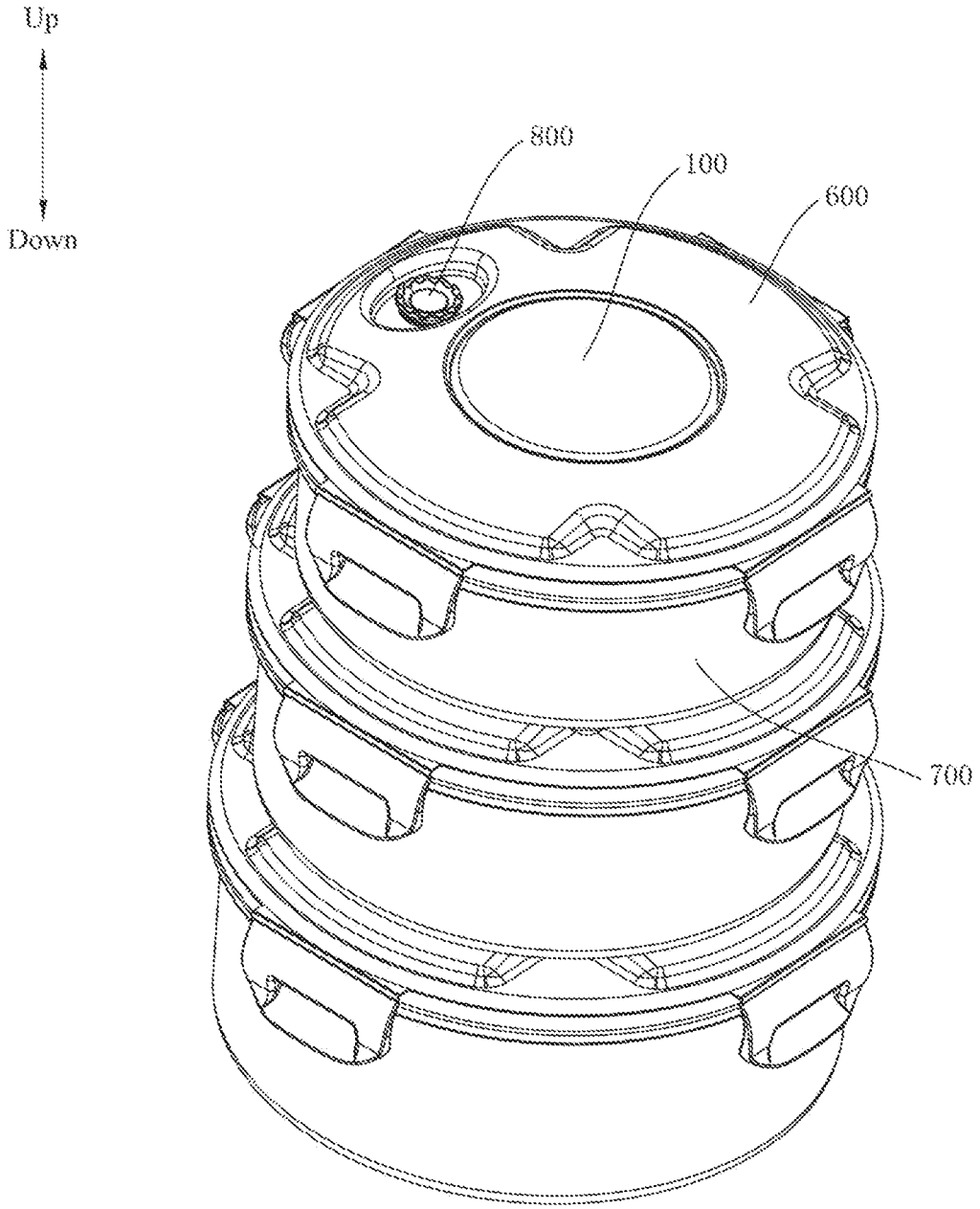
FIG. 12 is a schematic diagram of a structure of stacked round keep-fresh containers in an embodiment according to the present disclosure.
Figure 13:
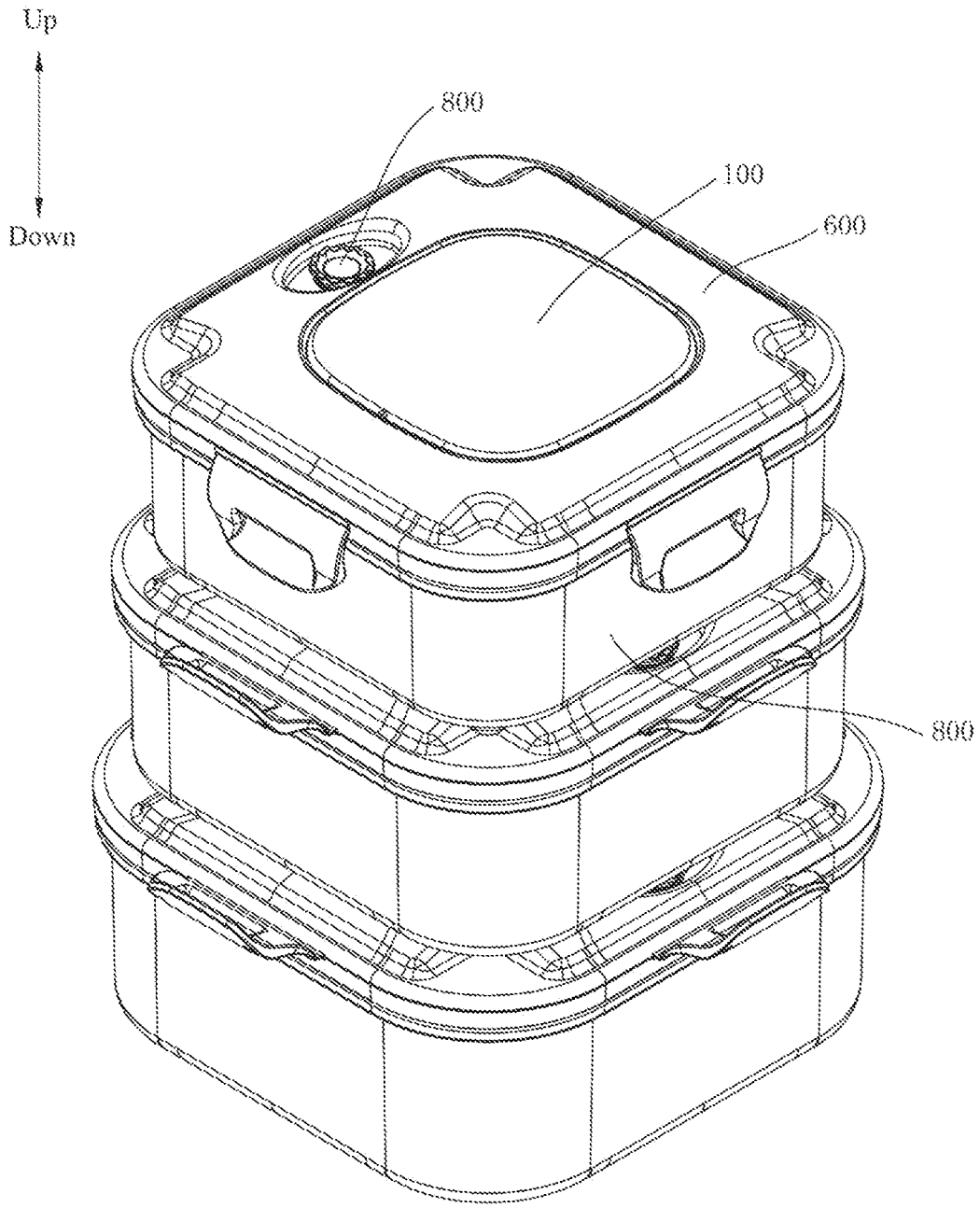
FIG. 13 is a schematic diagram of a structure of stacked square keep-fresh containers in an embodiment according to the present disclosure.

Referring to FIGS. 9 and 10, in some embodiments of the present disclosure, a bottom surface of the container body 700 is uniformly distributed with a plurality of support legs 720, an upper surface of the container cover 600 is uniformly distributed with a plurality of positioning grooves 640, and a plurality of support legs 720 on previous container body 700 can be correspondingly accommodated in a plurality of positioning grooves 640 of next container cover 600. The cooperation of the support legs 720 and the positioning grooves 640 can make the stacking of a plurality of keep-fresh containers more stable.

The embodiments of the present disclosure have been described in detail with reference to the accompanying drawings, however, the present disclosure is not limited to the foregoing embodiments. Various changes can be made within the knowledge of those of ordinary skill in the art without departing from the gist of the present disclosure.

The invention claimed is:

1. An air extraction structure, comprising:

an elastic press cover;

a seat fastened to and in sealing connection with the elastic press cover, wherein an air extraction chamber is formed between the elastic press cover and the seat, the seat is provided with a mounting hole, and a plurality of air extraction holes are arranged in a circumferential direction of the mounting hole;

a valve seat mounted on the seat, wherein the valve seat is provided with a receiving hole, and the receiving hole is communicated with the mounting hole and the air extraction hole;

a blocking member comprising a flexible diaphragm and a clamping part vertically arranged on a lower surface of the flexible diaphragm, wherein the clamping part passes through the receiving hole and the mounting hole and is clamped and placed on a lower surface of the seat, the lower surface of the flexible diaphragm is able to be attached to an upper surface of the valve seat and blocks the air extraction hole, the blocking member is movable along an axial direction of the mounting hole to control the communication or disconnection between the air extraction chamber and the air extraction hole, the lower surface of the flexible diaphragm has a first reinforcing rib extending circumferentially, and the first reinforcing rib can be attached to the upper surface of the valve seat; and a second reinforcing rib on an edge of the flexible diaphragm extending around a circumferential direction of the flexible diaphragm; and an air exhaust check valve mounted on the seat and configured to exhaust air from the air extraction chamber.

2. The air extraction structure according to claim 1, wherein an inner surface of the elastic press cover is provided with a sealing rib along a circumferential direction of the elastic press cover, the upper surface of the seat is provided with a sealing groove at a position corresponding to the sealing rib, and the sealing rib is able to be inserted into the sealing groove when the elastic press cover is fastened on the seat.

3. The air extraction structure according to claim 1, wherein the valve seat is provided with a protrusion, and the protrusion extends along a circumferential direction of the valve seat and is able to abut against the lower surface of the flexible diaphragm.

4. The air extraction structure according to claim 3, wherein the valve seat and the flexible diaphragm are both made of silicone material.

5. The air extraction structure according to claim 1, wherein the elastic press cover is made of PP material.

6. A keep-fresh container, comprising:

an air extraction structure, comprising:

an elastic press cover;

a seat fastened to and in sealing connection with the elastic press cover, wherein an air extraction chamber is formed between the elastic press cover and the seat, the seat is provided with a mounting hole, and a plurality of air extraction holes are arranged in a circumferential direction of the mounting hole;

a valve seat mounted on the seat, wherein the valve seat is provided with a receiving hole, and the receiving hole is communicated with the mounting hole and the air extraction hole;

a blocking member comprising a flexible diaphragm and a clamping part vertically arranged on a lower surface of the flexible diaphragm, wherein the clamping part passes through the receiving hole and the mounting hole and is clamped and placed on a lower surface of the seat, the lower surface of the flexible diaphragm is able to be attached to an upper surface of the valve seat and blocks the air extraction hole, the blocking member is movable along an axial direction of the mounting hole to control the communication or disconnection between the air extraction chamber and the air extraction hole, the lower surface of the flexible diaphragm has a first reinforcing rib extending circumferentially, and the first reinforcing rib can be attached to the upper surface of the valve seat; and a second reinforcing rib on an edge of the flexible diaphragm extending around a circumferential direction of the flexible diaphragm; and an air exhaust check valve mounted on the seat and configured to exhaust air from the air extraction chamber;

a container cover and a container body, wherein the container cover and container body are able to be in sealing connection; and the air extraction structure is sealed on the container cover, the container cover is provided with a communication hole, and the air extraction hole is communicated with the interior of the container body through the communication hole.

7. The keep-fresh container according to claim 6, wherein the container cover is further provided with a mounting groove, the air extraction structure is able to be accommodated in the mounting groove, an air exhaust chamber is formed between the seat and the mounting groove, an air exhaust groove is formed on a side surface outside the elastic press cover, the air exhaust groove is communicated with the air exhaust chamber, and air in the air extraction chamber is able to be exhausted outside the container cover through the air exhaust check valve, the air exhaust chamber and the air exhaust groove in sequence.

8. The keep-fresh container according to claim 6, wherein a middle part of the elastic press cover is arc-shaped and protrudes from an upper surface of the container cover, a lower surface of the container body is provided with an arc-shaped groove, a plurality of keep-fresh containers is able to be longitudinally stacked, and an arc-shaped groove on previous container body is matched with an elastic press cover of next container cover.

9. The keep-fresh container according to claim 8, wherein a bottom surface of the container body is uniformly distributed with a plurality of support legs, an upper surface of the container cover is uniformly distributed with a plurality of positioning grooves, and a plurality of support legs on previous container body is able to be correspondingly accommodated in a plurality of positioning grooves of next container cover.

10. The keep-fresh container according to claim 6, wherein the valve seat is provided with a protrusion, and the protrusion extends along a circumferential direction of the valve seat and is able to abut against the lower surface of the flexible diaphragm.

11. The keep-fresh container according to claim 10, wherein the valve seat and the flexible diaphragm are both made of silicone material.

12. The keep-fresh container according to claim 6, wherein the elastic press cover is made of PP material.

13. A keep-fresh container, comprising:

an air extraction structure, comprising:

an elastic press cover;

a seat fastened to and in sealing connection with the elastic press cover, wherein an air extraction chamber is formed between the elastic press cover and the seat, the seat is provided with a mounting hole, and a plurality of air extraction holes are arranged in a circumferential direction of the mounting hole;

a valve seat mounted on the seat, wherein the valve seat is provided with a receiving hole, and the receiving hole is communicated with the mounting hole and the air extraction hole;

a blocking member comprising a flexible diaphragm and a clamping part vertically arranged on a lower surface of the flexible diaphragm, wherein the clamping part passes through the receiving hole and the mounting hole and is clamped and placed on a lower surface of the seat, the lower surface of the flexible diaphragm is able to be attached to an upper surface of the valve seat and blocks the air extraction hole, the blocking member is movable along an axial direction of the mounting hole to control the communication or disconnection between the air extraction chamber and the air extraction hole, the lower surface of the flexible diaphragm has a first reinforcing rib extending circumferentially, and the first reinforcing rib can be attached to the upper surface of the valve seat; and an air exhaust check valve mounted on the seat and configured to exhaust air from the air extraction chamber; and an inner surface of the elastic press cover is provided with a sealing rib along a circumferential direction of the elastic press cover, the upper surface of the seat is provided with a sealing groove at a position corresponding to the sealing rib, and the sealing rib is able to be inserted into the sealing groove when the elastic press cover is fastened on the seat;

a container cover and a container body, wherein the container cover and container body are able to be in sealing connection; and the air extraction structure is sealed on the container cover, the container cover is provided with a communication hole, and the air extraction hole is communicated with the interior of the container body through the communication hole.

14. The keep-fresh container according to claim 13, wherein the valve seat is provided with a protrusion, and the protrusion extends along a circumferential direction of the valve seat and is able to abut against the lower surface of the flexible diaphragm.

15. The keep-fresh container according to claim 14, wherein the valve seat and the flexible diaphragm are both made of silicone material.

16. The keep-fresh container according to claim 13, wherein the elastic press cover is made of PP material.

17. The keep-fresh container according to claim 13, wherein the container cover is further provided with a mounting groove, the air extraction structure is able to be accommodated in the mounting groove, an air exhaust chamber is formed between the seat and the mounting groove, an air exhaust groove is formed on a side surface outside the elastic press cover, the air exhaust groove is communicated with the air exhaust chamber, and air in the air extraction chamber is able to be exhausted outside the container cover through the air exhaust check valve, the air exhaust chamber and the air exhaust groove in sequence.

18. The keep-fresh container according to claim 13, wherein a middle part of the elastic press cover is arc-shaped and protrudes from an upper surface of the container cover, a lower surface of the container body is provided with an arc-shaped groove, a plurality of keep-fresh containers is able to be longitudinally stacked, and an arc-shaped groove on previous container body is matched with an elastic press cover of next container cover.

19. The keep-fresh container according to claim 18, wherein a bottom surface of the container body is uniformly distributed with a plurality of support legs, an upper surface of the container cover is uniformly distributed with a plurality of positioning grooves, and a plurality of support legs on previous container body is able to be correspondingly accommodated in a plurality of positioning grooves of next container cover.

* * * * *